United States Patent [19]

Ozawa et al.

[11] Patent Number: 5,000,070

[45] **Date of Patent: * Mar. 19, 1991**

[54] CUTTER

[75] Inventors: Yoshio Ozawa, Kanagawa; Teruo Shibazaki, Saitama, both of Japan

[73] Assignee: Fuji Photo Film Co., Ltd., Kanagawa, Japan

[ * ] Notice: The portion of the term of this patent subsequent to Jun. 26, 2007 has been disclaimed.

[21] Appl. No.: 463,731

[22] Filed: Jan. 12, 1990

Related U.S. Application Data

[63] Continuation of Ser. No. 282,935, Dec. 8, 1988, Pat. No. 4,936,177, which is a continuation of Ser. No. 61,365, Jun. 15, 1987, abandoned.

[30] Foreign Application Priority Data

Jun. 19, 1986 [JP] Japan ..... 61-143930
Jun. 19, 1986 [JP] Japan ..... 61-143931
Jun. 19, 1986 [JP] Japan ..... 61-143932

[51] Int. Cl.[5] ..... B26D 1/08

[52] U.S. Cl. ..... 83/582; 83/628; 83/636

[58] Field of Search ..... 83/582, 583, 613, 628, 83/635, 636, 821, 825, 694

[56] References Cited

U.S. PATENT DOCUMENTS

| | | | |
|---|---|---|---|
| 2,351,093 | 6/1944 | Beckley | 83/583 |
| 2,707,996 | 5/1955 | Kalb | 83/628 |
| 3,242,786 | 3/1966 | Giordano | 83/582 |
| 3,376,775 | 4/1968 | Eliason | 83/582 |
| 3,738,213 | 6/1973 | Fairbanks | 83/628 |
| 4,476,760 | 10/1984 | Block et al. | 83/582 |

FOREIGN PATENT DOCUMENTS

| | | | |
|---|---|---|---|
| 115627 | 4/1978 | Japan | 83/636 |
| 1373201 | 11/1974 | United Kingdom | 83/582 |

*Primary Examiner*—Hien H. Phan
*Attorney, Agent, or Firm*—Sughrue, Mion, Zinn Macpeak & Seas

[57] ABSTRACT

A cutter for cutting a thin material by engagement between a movable blade and a fixed blade comprises a spring member which is disposed between the movable blade and a movable base for moving the movable blade in the direction of engagment and is adapted to urge the movable blade in a direction perpendicular to the linearly reciprocal motion of the movable base so as to bring the movable blade into contact with the fixed blade.

2 Claims, 7 Drawing Sheets

CUTTER

This is a continuation of application Ser. No. 07/282,935, filed Dec. 8, 1988, U.S. Pat. No. 4,936,177 which is a continuation of application Ser. No. 07/061,365 filed June 15, 1987 now abandoned.

BACKGROUND OF THE INVENTION

1. Field of the Invention

The present invention relates to a cutter for cutting a material such as paper by means of a shearing force.

2. Description of the Prior Art

Generally, a cutter for cutting a thin material such as photographic paper by means of a shearing force has a fixed blade and a movable blade which engages therewith. In an arrangement in which the movable blade engages with the fixed blade as the former reciprocates relative to the latter, it is necessary for the movable blade and the fixed blade to intersect each other in the shape of X as viewed along the moving plane of the movable blad. If the movable blade and the fixed blade are disposed simply in parallel, it is impossible to cut a thin material. For instance, in an ordinary pair of scissors, a pair of blades do not reciprocate linearly but rotate relative to each other. However, in this case as well, intersection in the X-shaped manner is maintained as in the case of the reciprocating cutter.

In order to engage the movable blade with the fixed blade in the X-shaped manner, it is necessary to install the movable blade on a movable base for reciprocating the same, and an urging means is required to generate a force for engaging the movable blade with the fixed blade. Generally, a structure is adopted in which the movable blade is made rotatable about an axis which is parallel to a cutting line, i.e., the line of the edge of the fixed blade, the movable blade is urged by a resilient member, and the edge of the movable blade is engaged with that of the fixed blade. In this case, however, since the fixed blade moves by a slight amount by means of this urging force, it is impossible to cut the material at accurate intervals.

SUMMARY OF THE INVENTION

Accordingly, an object of the present invention is to provide a cutter which is capable of cutting a material to accurate dimensions with a simple structure, thereby overcoming the drawback of the prior art.

To this end, according to the present invention, there is provided a cutter for cutting a thin material by means of a shearing force, comprising a fixed blade; a movable base which is linearly reciprocatable with respect to the fixed blade; a movable blade for engagement with the fixed blade; and supporting means which supports the movable blade on the movable base at a plurality of portions along the cutting direction of the material and which is adapted to bring the movable blade into contact with the fixed blade by means of an urging force which urges the movable blade in a direction perpendicular to the direction of the linearly reciprocal motion thereof.

The aforementioned supporting means, in one form, may be an integral leaf spring or a plurality of leaf springs.

Accordingly, the number of parts employed in the present invention is small since the leaf spring for mounting the movable blade on the movable base functions as a means which generates a force for bringing the movable blade into contact with the fixed blade, i.e., a force in the engaging direction. In addition, since the movable blade is pressed against the fixed blade so as to generate the force in the engaging direction, there is no need to move the fixed blade by a slight amount, as has been the case in the past, and the edge line is always at a fixed position. Accordingly, the cutting plane of the material is always at a steady position, and the material can be cut at accurate intervals.

In addition, the supporting means in another form may be constituted by hinge means and a resilient member.

It suffices if the hinge means for mounting the movable blade on the movable base are plural and three or more hinge means may be employed. These hinge means constantly impart appropriate forces in the engaging direction as their urging forces are changed, thereby ensuring that cutting work is effected positively. As for the means for changing the urging forces, the urging forces can be altered by changing the dimensions of the spring by altering the width, length, thickness of the resilient member or by superposing a plurality of resilient members. In some cases, the urging forces may be altered by changing their material used.

In addition, if the plurality of hinge means are disposed such as to be respectively spaced apart in a direction perpendicular to the moving direction of the movable blade, and if the urging forces are altered in such a way that the engaging force of a portion of the movable blade which first engages with the fixed blade is made greater than that of a portion of the movable blade which later engages therewith, a desirable force in the engaging direction can be obtained from the early stage until the final stage of engagement.

DESCRIPTION OF THE PREFERRED EMBODIMENTS

Figure 1:
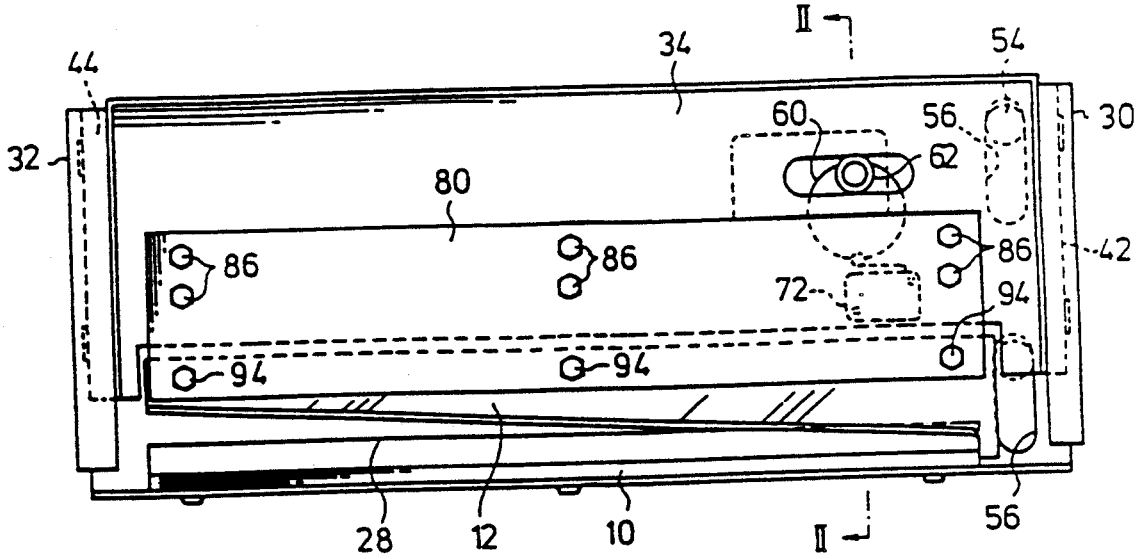
FIG. 1 is a front elevational view illustrating a cutter in accordance with a first embodiment of the present invention.

As shown in FIGS. 1 to 4, this embodiment is arranged in such a manner that photographic paper 14, which is a material to be cut, is cut by a combination of a fixed blade 10 and a movable blade 12.

The fixed blade 10 is supported by a fixing frame 18 via a mounting bracket 16. This mounting bracket 16 is formed by a relatively thick steel plate, and an upper end portion thereof is bent orthogonally and serves as a flange portion 20 for mounting on the fixing frame 18. This flange portion 20 is provided with through holes 22 for securing screws which secure the mounting bracket 16.

A flange portion 24 which is bent orthogonally and disposed opposite to the flange portion 20 is formed in the lower end portion of the mounting bracket 16. The fixed blade 10 is secured to this flange portion 24 by means of screws 26. A rectangular opening 28 for feeding the photographic paper 14 from a printing apparatus (not shown) onto the fixed blade 10 is formed in the vicinity of the flanged portion 24.

The edge of the fixed blade 10 which comes into contact with the movable blade 12 is linear and is perpendicular to the advancing direction of the photographic paper 14.

Guide arms 30, 32 each having a U-shaped cross section are formed vertically at transverse opposite end portions of the mounting bracket 16 in a face-to-face relationship with each other. The arrangement is such that the movable base 34 is raised and lowered while it is guided by the guide arms 30, 32.

The movable base 34 is also formed by a relatively thick steel plate as in the case of the mounting bracket 16, and an upper end portion and side portions thereof are bent orthogonally in the same direction, thereby constituting a bent portion 36 and shoe mounting portions 38, 40.

Block-shaped shoes 42, 44 are respectively secured to the shoe mounting portions 38, 40 by means of screws 46. The shoes 42, 44 have a size for entering the inside of the guide arms 30, 32, and serve to guide the movable base 34 while sliding along the interior of the guide arms 30, 32.

One side of an angle 48 together with the shoe 42 is secured to the side of the shoe mounting portion 38 opposite to the shoe 42 by means of screws 46. Shafts 50 are secured to the other side of the angle 48 by means of nuts 52. The outer peripheral portion of a bearing 54 which is installed on each of these shafts 50 is inserted in an elongated hole 56 formed in the mounting bracket 16. This elongated hole 56 is provided vertically in the moving direction of the movable blade 12, and serves to allow the movable blade 12 to move linearly.

An elongated hole 58 is formed in the movable base 34 at a position closer to the shoe mounting portion 38 so as to extend perpendicularly to the moving direction of the movable blade 12. A bearing 62 is fixed in this elongated hole 58 at a position eccentric with the rotational axis of a disc cam 60. The axis of the cam 60 is concentrically secured to an output shaft 66 of a motor 64. The motor 64 is secured to the rear surface of the mounting bracket 16, and the output shaft 66 penetrates a circular hole 68 formed in the mounting bracket 16, a tip portion thereof being secured to the cam 60.

A projection 70 for separating the mounting portion for the motor 64 from the movable base 34 is formed in a portion of the mounting bracket 16. A limit switch 72 is fixed to the mounting bracket 16 such as to be adjacent to to cam 60. The arrangement is such that, as the cam 60 rotates, a detection terminal 74 of the limit switch 72 comes into contact with a groove 76 formed in a portion of the cam 60 to detect the same, and stops the bearing 62 at its top dead center (the state shown in FIG. 1).

Consequently, when the motor 64 rotates the cam 60, the bearing 62 is adapted to move the movable base 34 vertically relative to the mounting bracket 16 via the elongated hole 58. The amount of this vertical movement is two times the amount of eccentricity of the bearing 62 installed on the cam 60.

The movable blade 12 is supported by the lower end portion of the movable base 34 via a leaf spring 80 which constitutes a supporting means. This leaf spring in this embodiment has a uniform thickness, and is rectangular as viewed in the direction of its thickness. A pair of circular holes 88 for penetration of screws 86 therethrough are formed at three portions in this leaf spring. Accordingly, a total of six screws 86 are used, and are screwed into threaded holes 90 formed in the movable base 34.

In addition, three circular holes 92 are formed in the leaf spring in the vicinity of a tip portion thereof, and screws 94 penetrate the same. The screws 94 are screwed into threaded holes 96 formed in the movable blade 12.

The axes of the pairs of screws 86 and the screws 94 are arranged in the same plane. For this reason, the leaf spring 80 secures the movable blade 12 to the movable bas 34 at three portions each spaced apart in a direction perpendicular to the moving direction of the movable blade 12, but since the leaf spring 80 is integrally formed, the movable blade 12 is secured positively.

The circular holes 92 and the threaded holes 96 are arranged upwardly of the portion of engagement between the movable balde 12 and the fixed blade 10 in the state in which the movable blade 12 is lowered by a maximum amount (i.e., the bottom dead center).

Figure 2:
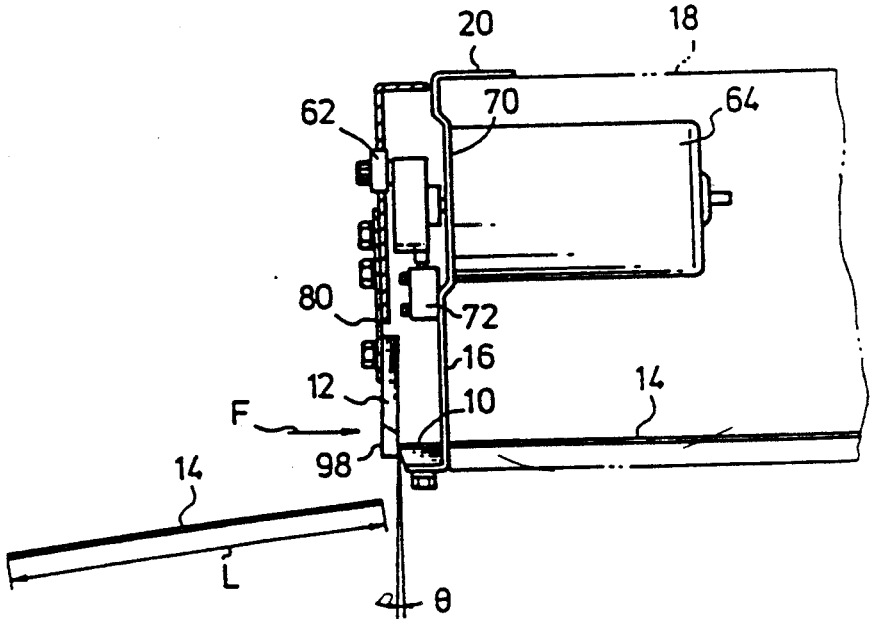
FIG. 2 is a cross-sectional view taken along the line II—II of FIG. 1.
Figure 3:
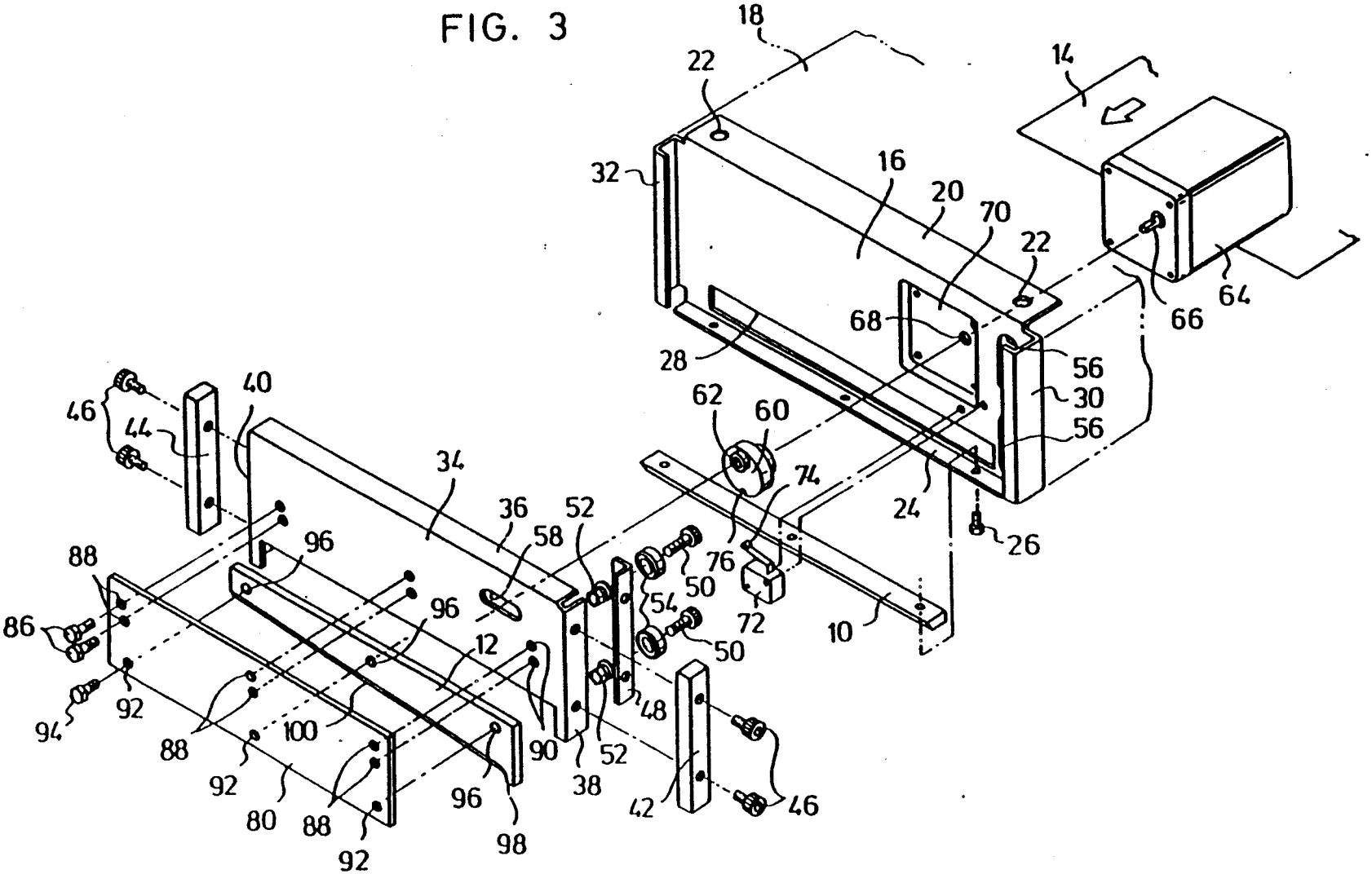
FIG. 3 is an exploded perspective view of the first embodiment.
Figure 4:
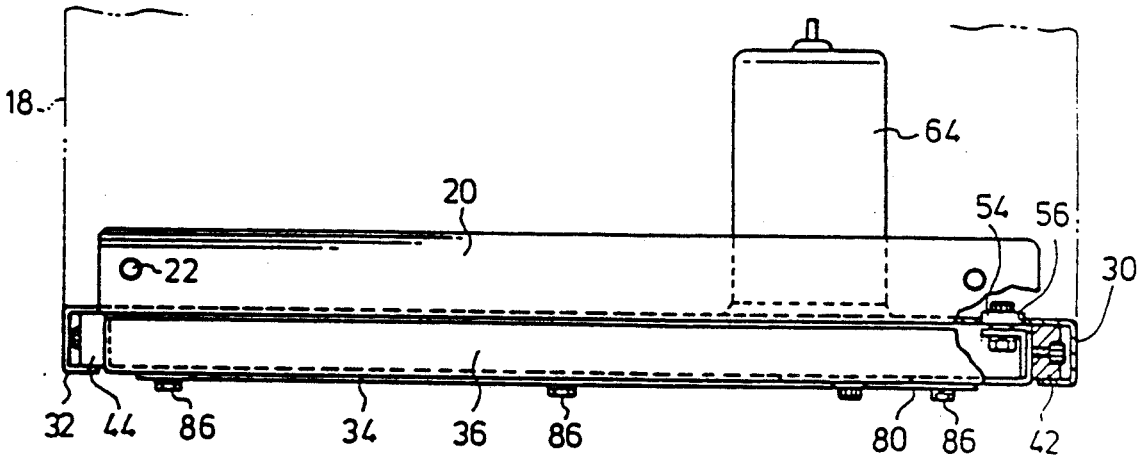
FIG. 4 is a top plan view of the cutter shown in FIG. 1.

As shown in FIG. 2, the leaf spring 80 also serves to urge the movable blade 12 in the direction of engagement with the photographic paper 14 (i.e., in the direction of the arrow F). For this reason, even when the movable blade 12 is at the top dead center, a guide projection 98 formed at a lower end portion of the movable blade 12 is engaged with the edge of the fixed blade 10. In this state, although an inclined edge 100 of the movable blade 12 is separated from the edge of the fixed blade 10, when the movable blade 12 is gradually lowered, the portion of the inclined edge 100 which is close to the guide projection 98 is capable of gradually engaging with the edge of the movable blade 12.

Furthermore, as shown by an angle $\theta$ in FIG. 2, the leaf spring 80 displaces the movable blade 12 with respect to the photographic paper 14 by an angle $\theta$ in the direction of engagement (i.e., in the direction of the arrow F). This angle $\theta$ is designed to produce a force of engagement between the movable blade 12 and the fixed blade 10. The arrangement is such that, even if large dimensional tolerances are provided for gaps between the shoes 42, 44, which constitute the guide means for lifting and lowering the movable base 34, and the guide arms 30, 32, and clearances are created between the shoes 42, 44 and the guide arms 30, 32 after frequent use owing to the wear of the shoes 42, 44, the engagement between the movable blade 12 and the fixed blade 10 can be maintained because of the presence of this angle.

Figure 5:
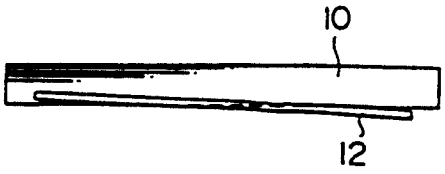
FIG. 5 is a top plan view illustrating engagement between a fixed blade and a movable blade.

In addition, this leaf spring 80 is arranged in such a manner that the edge of the movable blade 12 intersects the edge of the fixed blade 10 in the X-shaped manner as viewed in the moving direction of the movable blade 12, as shown in FIG. 5. In order to secure this state of intersection between the fixed blade 10 and the movable blade 12 even after the progression of cutting, it is preferable to make the left-hand side urging force of the leaf spring 80 greater than the right-hand side as viewed in FIG. 1, thereby increasing the force in the engaging direction. For this purpose, a measure may be provided to increase the urging force, such as by partially increasing the thickness of the leaf spring, or by using an additional leaf spring for imparting an auxiliary urging force. In addition, if the interval between the screws 86 and 94 is changed between the right- and left-hand sides in FIG. 1, the force in the engaging direction can be adjusted since the length of projection of the leaf spring 80 from the movable base 34 is changed substantially between the right- and left-hand sides.

Description will now be made of the operation of this embodiment.

When the photographic paper 14 is sent through the rectangular opening 28, the motor 64 rotates upon receipt of a cutting operation signal. Consequently, the cam 60 rotates, and the bearing 62 lowers the movable base 34 via the elongated hole 58. As a result, the inclined edge 100 of the movable blade 12 which is close to the guide projection 98 engages with the edge of the fixed blade 10 and starts cutting the photographic paper 14. When cutting is started, the movable blade 12 receives a reactionary force of cutting, and a portion thereof in the vicinity of the guide proJection 98 generates an upwardly moving force as viewed in FIG. 1. However, since the bearing 62 is guided by the elongaged hole 56, the movable blade 12 maintains its posture.

When the motor 64 rotates further, the movable blade 12 completely cuts the photographic paper 14, and is raised again after reaching the bottom dead center. When the limit switch 72 detects the groove 76 of the cam 60, the power supply to the motor 64 is stopped at the top dead center, so that the movable blade 12 stops at the top dead center.

During such engagement, the leaf spring 80 is deformed, and midway in the cutting the state of the X-shaped intersection between the movable blade 12 and the fixed blade 10, shown in FIG. 5, and the inclination of the angle $\theta$ shown in FIG. 2 are maintained, thereby enabling positive cutting Since the photographic paper 14 which is cut has its cutting line constantly located at the edge portion of the fixed blade 10 which is in the fixed state, the cutting dimension L (refer to FIG. 2) is accurate.

Although, in the above-described embodiment, a combination of the motor 64 and the cam 60 is employed to raise and lower the movable base 34, it goes without saying that another form of raising and lowering means may be employed in the present invention.

Figure 6:
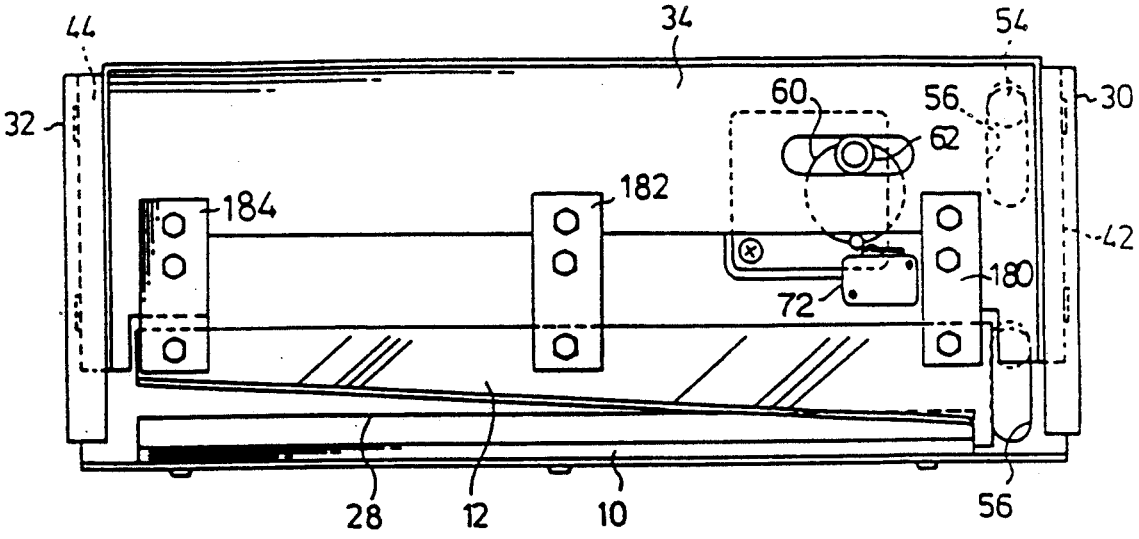
FIG. 6 is a front elevational view of a cutter in accordance with a second embodiment.
Figure 7:
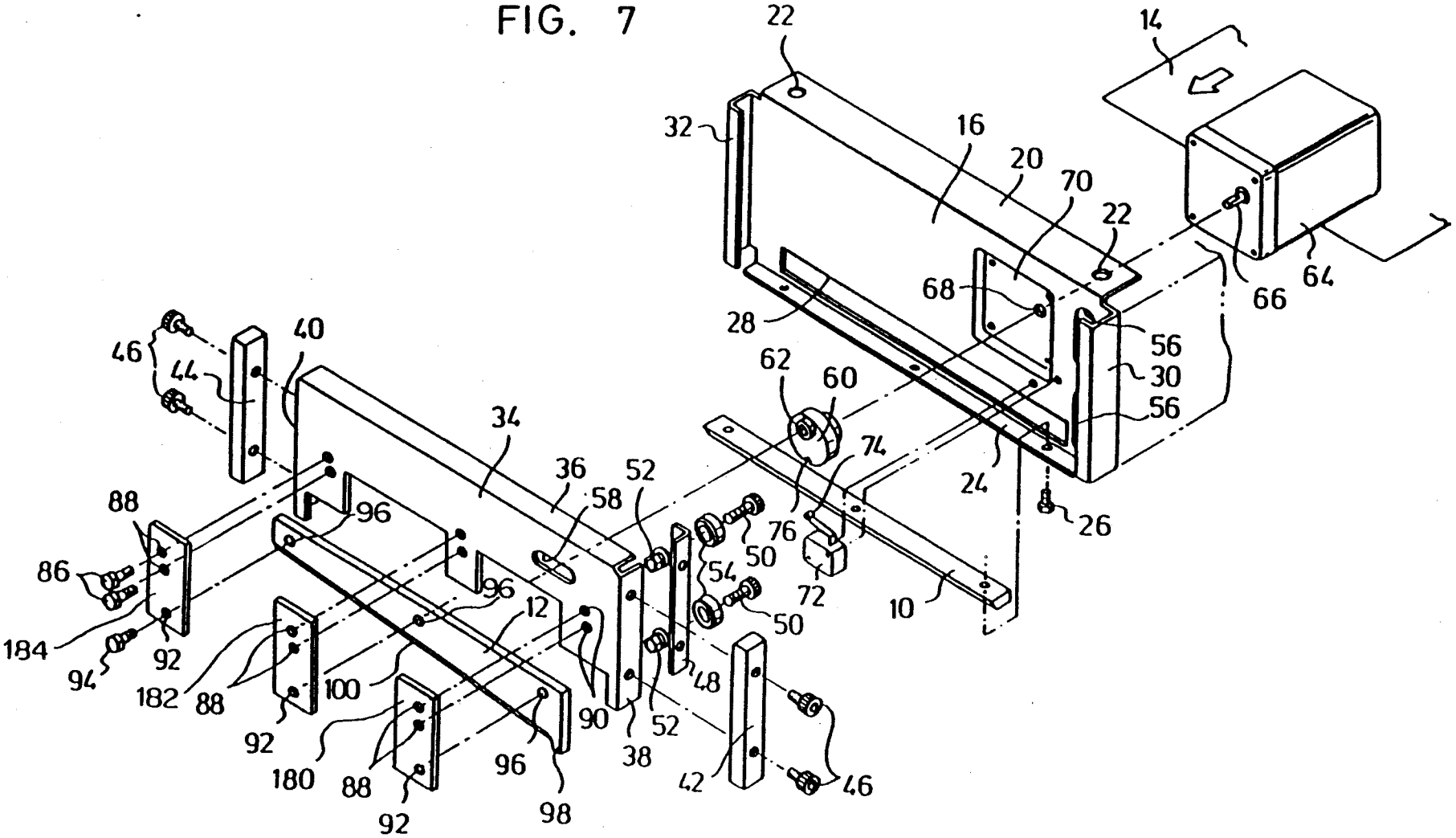
FIG. 7 is an exploded perspective view of the second embodiment.

Referring next to FIGS. 6 and 7, a detailed description of a second embodiment of the present invention will be made.

In this embodiment, the same parts and members as those of the firs embodiment are denoted by the same reference numerals, and a detailed description thereof will be omitted.

The major difference between this embodiment and the first embodiment lies in the arrangement of the leaf spring for supporting the movable blade 12 by the movable base 34.

In other words, in this embodiment, three leaf springs 180, 182, and 184 are provided on a lower end portion of the movable base 34 to support the movable blade 12. These leaf springs in this embodiment have the same thickness, and are rectangular as viewed in the direction of their thickenss. Each of these leaf springs is provided with the circular holes 88 for penetration of the pair of screws 86 therethrough, as in the case of the first embodiment. These screws 86 are screwed into the threaded holes 90 formed in the movable base 34.

Each of these leaf springs is provided with the circular hole 92 in the vicinity of its tip portion, and the screw 94 penetrates therethrough These screws 94 are screwed into the threaded holes 96 formed in the movable blade 12.

Consequently, these leaf springs are adapted to fix the movble blade 12 to the movable base 34 at three portions each spaced apart in a direction perpendicular to the moving direction of the movable blade 12.

These circular holes 92 and the threaded holes 96 are arranged in such a manner as to be disposed upwardly of the portion of engagement between the movable blade 12 and the fixed blade 10 in the state in which the movable blade 12 is lowered by a maximum amount (i.e., the bottom dead center).

The leaf springs 180, 182, and 184 also serve to urge the movable blade 12 in the direction of engagement with the photographic paper 14 (i.e., the same direction as that of the arrow F in FIG. 2 in the first embodiment). Consequently, when the movable blade 12 is at the top dead center, the guide projection 98 formed at the lower end portion of the movable blade 12 engage with the edge of the fixed blade 10. In this state, although an inclined edge 100 of the movable blade 12 is separated from the edge of the fixed blade 10, when the movable blade 12 is gradually lowered, the portion of the inclined edge 100 which is close to the guide projection 98 is capable of gradually engaging with the edge of the movable blade 12.

Furthermore, the leaf springs 180, 182, 184 displace the movable blade 12 with respect to the photographic paper 14 by the same angle as that of $\theta$ shown in FIG. 2 in the first embodiment in the direction of engagement (i.e., in the same direction as that of the arrow F in the first embodiment). This angle is designed to produce a force of engagement between the movable blade 12 and the fixed blade 10. The arrangement is such that, even if large dimensional tolerances are provided for gaps between the shoes 42, 44, which constitute the guide means for lifting and lowering the movable base 34, and the guide arms 30, 32, and clearances are created between the shoes 42, 44 and the guide arms 30, 32 after frequent use owing to the wear of the shoes 42, 44, the engagement between the movable blade 12 and the fixed blade 10 can be maintained because of the presence of this angle.

In addition, these leaf springs 180, 182, 184 are arranged in such a manner that the edge of the movable blade 12 intersects the edge of the fixed blade 10 in the X-shaped manner as viewed in the moving direction of the movable blade 12, as in the case of the first embodiment shown in FIG. 5. In order to secure this state of intersection between the fixed blade 10 and the movable blade 12 even after the progression of cutting, it is preferable to make the the force in the engaging direction obtained by the leaf spring 184 greater than that obtained by the leaf springs 180, 182. For this purpose, a measure may be provided to increase the urging force, such as by making the thickness of the leaf spring 184 greater than that of the leaf springs 180, 182, or by superposing a plurality of leaf springs. In addition, it is more preferable to set the force in the engaging direction obtained by the leaf spring 182 equivalent to or greater than that obtained by the leaf spring 180.

Description of the other arrangements will be omitted since they are the same as those of the first embodiment.

Description will now be made of the operation of this embodiment.

When the photographic paper 14 is sent through the rectangular opening 28, the motor 64 rotates upon receipt of a cutting operation signal. Consequently, the cam 60 rotates, and the bearing 62 lowers the movable base 34 via the elongated hole 58. As a result, the inclined edge 100 of the movable blade 12 which is close to the guide projection 98 engages with the edge of the fixed blade 10 and starts cutting the photographic paper 14. When cutting is started, the movable blade 12 receives a reactionary force of cutting, and a portion thereof in the vicinity of the guide projection 98 generates an upwardly moving force as viewed in FIG. 6. However, since the bearing 62 is guided by the elongaged hole 56, the movable blade 12 maintains its posture.

When the motor 64 rotates further, the movable blade 12 completely cuts the photographic paper 14, and is raised again after reaching the bottom dead center. When the limit switch 72 detects the groove 76 of the cam 60, the power supply to the motor 64 is stopped at the top dead center, so that the movable blade 12 stops at the top dead center.

During such engagement, the leaf springs 180, 182, 184 impart separate forces in the engaging direction, and the state of the X-shaped intersection between the movable blade 12 and the fixed blade 10 as in the state shown in FIG. 5 in the first embodiment, and the inclination of the same angle as that of $\theta$ shown in FIG. 2 in the first embodiment are maintained midway in cutting, thereby enabling positive cutting.

Since the photographic paper 14 which is cut has its cutting line constantly located at the edge portion of the fixed blade 10 which is in the fixed state, so that the cutting dimension is accurate.

Although, as in the first embodiment, a combination of the motor 64 and the cam 60 is employed to raise and lower the movable base 34, it goes without saying that another form of raising and lowering means may be employed in the present invention.

Figure 8:
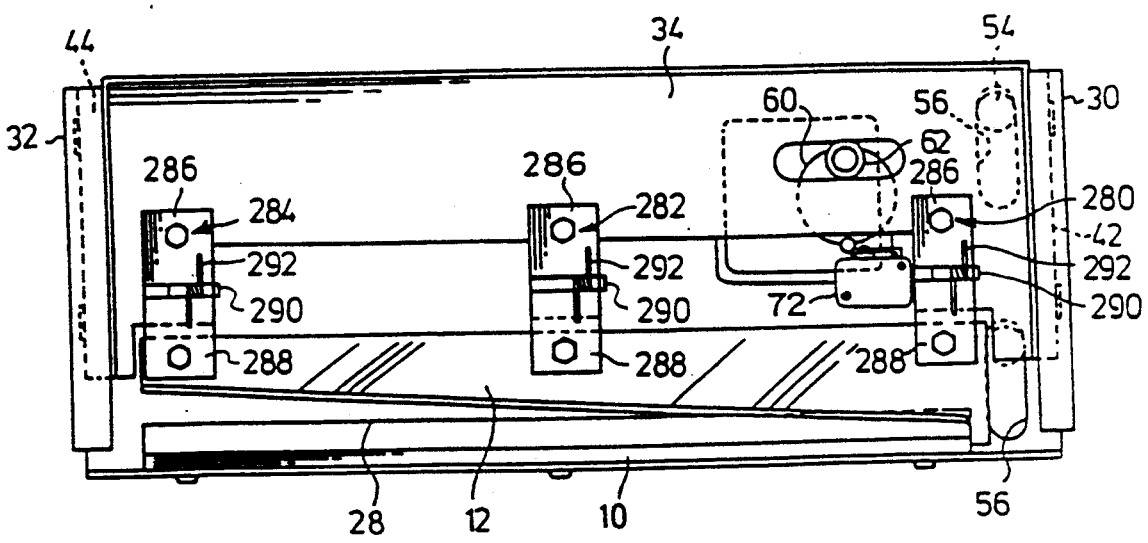
FIG. 8 is a front elevational view illustrating a cutter in accordance with a third embodiment.
Figure 9:
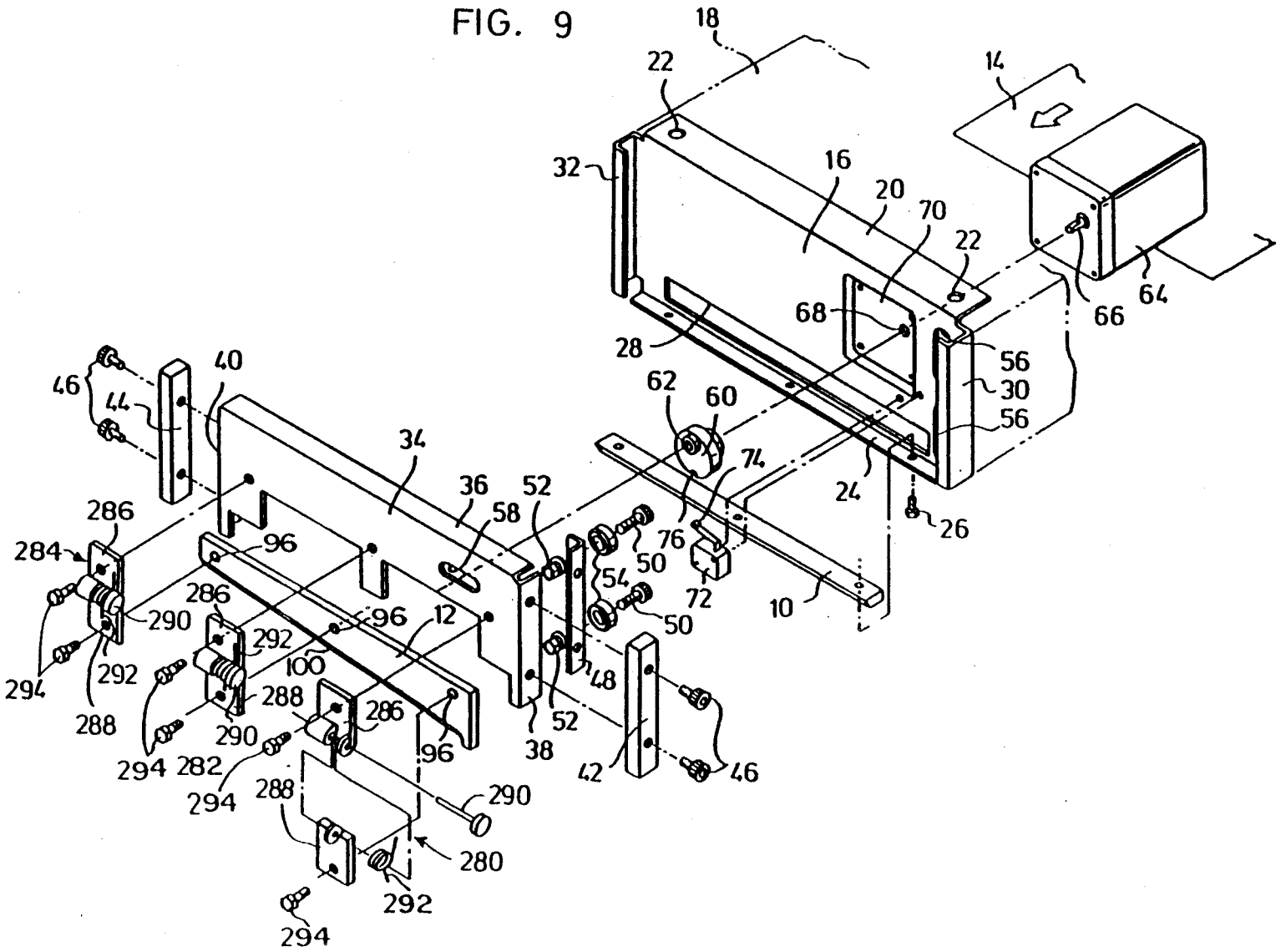
FIG. 9 is an exploded perspective view of the third embodiment.

Referring now to FIGS. 8 and 9, a detailed description of a third embodiment will be made.

In this embodiment as well, the same parts and members as those of the first embodiment are denoted by the same reference numerals, and a detailed description thereof will be omitted.

The major difference between this embodiment and the first embodiment lies in the arrangement of supporting the movable blade 12 by the movable base 34.

In other words, in this embodiment, the movable blade 12 is pivotally supported by the lower end portion of the movable base 34 via hinge means 280, 282, and 284.

Each of these hinge means is constituted by a hinge in which one leaf 286 and the other leaf 288, both formed by a plate material, are pivotally supported by a pin 290 at their end portions. A torsional coil spring 292 is pivotally supported by the pin 290, and this torsional coil spring 292 rotatively urges the leaves 286, 288 about the pin 290.

The leaves 286, 288 are secured to the movable base 34 and the movable blade 12, respectively, by means of screws 294. Through this arrangement, the hinge means 280, 282, and 284 pivotally support the movable blade 12 against the movable base 34 at three portions each spaced apart in a direction perpendicular to the moving direction of the moving blade 12. In this case, the hinge means are preferably arranged in such a manner that the pins 90 are disposed concentrically and the movable blade 12 is swingable with respect to the movable base 34. The arrangement is such that the movable blade 12 installed is urged in the direction of its engagement with the edge of the fixed blade 10 (i.e., in the same direction as that of the arrow F shown in FIG. 1 in the first embodiment) by the urging force of the torsional coil springs 292. Consequently, even when the movable blade 12 is at its top dead center, the guide projection 98 formed at the lower end portion of the movable blade 12 engages with the edge of the fixed blade 10. In this state, although the inclined edge 100 of the movable blade 12 is separated from the edge of the fixed blade 10, when the movable blade 12 is gradually lowered, the portion of the inclined edge 100 which is close to the guide projection 98 is capable of gradually engaging with the edge of the movable blade 12.

Furthermore, the hinge means 280, 282, 284 displace the movable blade 12 with respect to the photographic paper 14 by the same angle as that of 8 shown in FIG. 2 in the first embodiment in the direction of engagement (i.e., in the same direction as that of the arrow F in the first embodiment). The angle produced by this displacement is designed to produce a force of engagement between the movable blade 12 and the fixed blade 10. The arrangement is such that, even if large dimensional tolerances are provided for gaps between the shoes 42, 44, which constitute the guide means for lifting and lowering the movable base 34, and the guide arms 30, 32, and clearances are created between the shoes 42, 44 and the guide arms 30, 32 after frequent use owing to the wear of the shoes 42, 44, the engagement between the movable blade 12 and the fixed blade 10 can be maintained because of the presence of this angle.

Incidentally, the screws 294 which are used to mount the hinge means on the movable blade 12 are disposed upwardly of the portion of engagement between the movable blade 12 and the fixed blade 10 in the state in which the movable blade 12 is lowered by a maximum amount (i.e., the bottom dead center).

Furthermore, these hinge means 280, 282, 284 are arranged in such a manner that .the edge of the movable blade 12 intersects the edge of the fixed blade 10 in the X-shaped manner as viewed in the moving direction of the movable blade 12, as in the case of the first embodiment shown in FIG. 5. For this purpose, an arrangement may be provided such that the hinge means are made elastically deformable, or the surface of installation of the hinge means on the movable base 34 is disposed such as to intersect the edge line of the fixed blade 10 as viewed from a plane.

In order to secure this state of intersection between the fixed blade 10 and the movable blade 12 even after the progression of cutting, it is preferable to make the force in the engaging direction obtained by the hinge means 284 greater than that obtained by the hinge means 280, 282.

Description will now be made of the operation of this embodiment.

When the photographic paper 14 is sent through the rectangular opening 28, the motor 64 rotates upon receipt of a cutting operation signal. Consequently, the cam 60 rotates, and the bearing 62 lowers the movable base 34 via the elongated hole 58. As a result, the inclined edge 100 of the movable blade 12 which is close to the guide projection 98 engages with the edge of the fixed blade 10 and starts cutting the photographic paper 14. When cutting is started, the movable blade 12 receives a reactionary force of cutting, and a portion thereof in the vicinity of the guide projection 98 generates an upwardly moving force as viewed in FIG. 8. However, since the bearing 62 is guided by the elongaged hole 56, the movable blade 12 maintains its posture.

When the motor 64 rotates further, the movable blade 12 completely cuts the photographic paper 14, and is raised again after reaching the bottom dead center. When the limit switch 72 detects the groove 76 of the cam 60, the power supply to the motor 64 is stopped at the top dead center, so that the movable blade 12 stops at the top dead center.

During such engagement, the hinge means 280, 282, 284 impart separate forces in the engaging direction, and the state of the X-shaped intersection between the movable blade 12 and the fixed blade 10 as in the state shown in FIG. 5 in the first embodiment, and the inclination of the same angle as that of 0 shown in FIG. 2 in the first embodiment are maintained midway in cutting, thereby enabling positive cutting.

The photographic paper 14 which is cut has its cutting line constantly located at the edge portion of the fixed blade 10 which is in the fixed state, so that the cutting dimension is accurate.

Although, as in the first and second embodiments, a combination of the motor 64 and the cam 60 is employed to raise and lower the movable base 34, it goes without saying that another form of raising and lowering means may be employed in the present invention. In addition, as for the torsional coil springs 92 which impart an engaging force to the movable blade 12 for engagement with the fixed blade 10, it is possible to employ a leaf spring or other similar resilient member, and the torsional coil springs 92 may be provided on portions other than the hinge means.

What is claimed is:

1. A cutter for cutting a thin material by means of a shearing force, comprising:

a fixed blade;

a movable base which is linearly reciprocatable in a first direction with respect to said fixed blade, said movable base being formed as a plate;

a movable blade, having a cutting edge extending in a second direction, for engagement with said fixed blade; and supporting means for supporting said movable blade on said movable base at a plurality of portions with respect to the first direction and for bringing said movable blade into contact with said fixed blade by means of an urging force which urges said movable blade in a third direction which is perpendicular to the first direction, wherein said supporting means comprises hinge means provided at each of said plurality of portions and a resilient member which is provided between said movable blade and said movable base and which is adapted to bring said movable blade into contact with said fixed blade by means of a force that urges said movable blade in the third direction.

2. A cutter for cutting a thin material by means of a shearing force, comprising:

a fixed blade;

a movable base which is linearly reciprocatable in a first direction with respect to said fixed blade, said movable base being formed as a plate;

a movable blade, having a cutting edge extending in a second direction, for cutting said material by engagement with said fixed blade;

supporting means for supporting said movable blade on said movable base at a plurality of portions with respect to the second direction in such a manner that an edge of said movable blade is at a predetermined angle of inclination with respect to an edge of said fixed blade and for bringing said movable blade into contact with said fixed blade by means of an urging force which urges said movable blade in a third direction which is perpendicular to the first direction; and driving means for linearly reciprocating said movable base, wherein said supporting means comprises hinge means provided at each of said plurality of portions and a resilient member which is provided between said movable blade and said movable base and which is adapted to bring said movable blade into contact with said fixed blade by means of an urging force which urges said movable blade in said third direction.

* * * * *